US005685081A

United States Patent [19]

Winegar

[11] Patent Number: 5,685,081

[45] Date of Patent: Nov. 11, 1997

[54] AIMING DEVICE FOR USE ON ARCHERY BOWS

[76] Inventor: Mike Winegar, 16669 83rd Ave., Maple Grove, Minn. 55311

[21] Appl. No.: 525,225

[22] Filed: Sep. 8, 1995

[51] Int. Cl.[6] ..... F41G 1/467

[52] U.S. Cl. ..... 33/265; 33/241

[58] Field of Search ..... 33/241, 265; 277/110; 124/87

[56] References Cited

U.S. PATENT DOCUMENTS

| | | | |
|---|---|---|---|
| 529,424 | 11/1894 | Skoda . | |
| 2,069,177 | 1/1937 | Craver | 277/110 |
| 2,706,335 | 4/1955 | Munsey | 33/241 |
| 3,678,127 | 7/1972 | Schmid et al. | 260/830 P |
| 3,945,127 | 3/1976 | Spencer | 33/265 |
| 4,166,324 | 9/1979 | Carollo et al. | 33/241 |
| 4,170,071 | 10/1979 | Mann et al. | 33/265 |
| 4,177,572 | 12/1979 | Hindes | 33/265 |
| 4,195,414 | 4/1980 | Robinson | 33/265 |
| 4,226,432 | 10/1980 | Nakamizo | 277/110 |
| 4,325,190 | 4/1982 | Duerst | 33/265 |
| 4,387,267 | 6/1983 | Becker | 277/110 |
| 4,400,887 | 8/1983 | Mason | 33/265 |
| 4,495,705 | 1/1985 | Kowalski et al. | 33/265 |
| 4,819,611 | 4/1989 | Sappington | 124/87 |
| 4,928,394 | 5/1990 | Sherman | 33/265 |
| 5,048,193 | 9/1991 | Hacquet | 33/265 |
| 5,094,002 | 3/1992 | Saunders | 33/265 |
| 5,122,932 | 6/1992 | Ziller | 362/32 |
| 5,152,068 | 10/1992 | Meister et al. | 33/265 |
| 5,201,124 | 4/1993 | Sherman | 33/265 |
| 5,231,765 | 8/1993 | Sherman | 331/241 |
| 5,341,791 | 8/1994 | Shafer | 124/87 |
| 5,375,047 | 12/1994 | Mueller | 362/253 |
| 5,442,861 | 8/1995 | Lorocco | 33/241 |
| 5,560,113 | 10/1996 | Simo et al. | 33/241 |

FOREIGN PATENT DOCUMENTS

| | | | |
|---|---|---|---|
| 4214997 | 11/1993 | Germany | 33/241 |
| 182003 | 12/1962 | Sweden | 33/265 |

*Primary Examiner*—Thomas B. Will
*Attorney, Agent, or Firm*—Haugen & Nikolai, PA

[57] ABSTRACT

A sighting pin for attachment to a sighting mount of an archery bow, wherein a fiber optic rod is partially enclosed by a sheath to thereby increase the gathering and enhancing light properties of the fiber optic is disclosed. The fiber optic is enclosed by a sheath that has a window formed therein, thereby increasing the amount of light collecting surface area exposed. One or both ends of the fiber optic may have a geometric shape formed thereon, which increases the illumination of the end. An end cap is removably attached to an end of the sheath, and allows for the precise horizontal adjustment of the sighting pin.

16 Claims, 3 Drawing Sheets

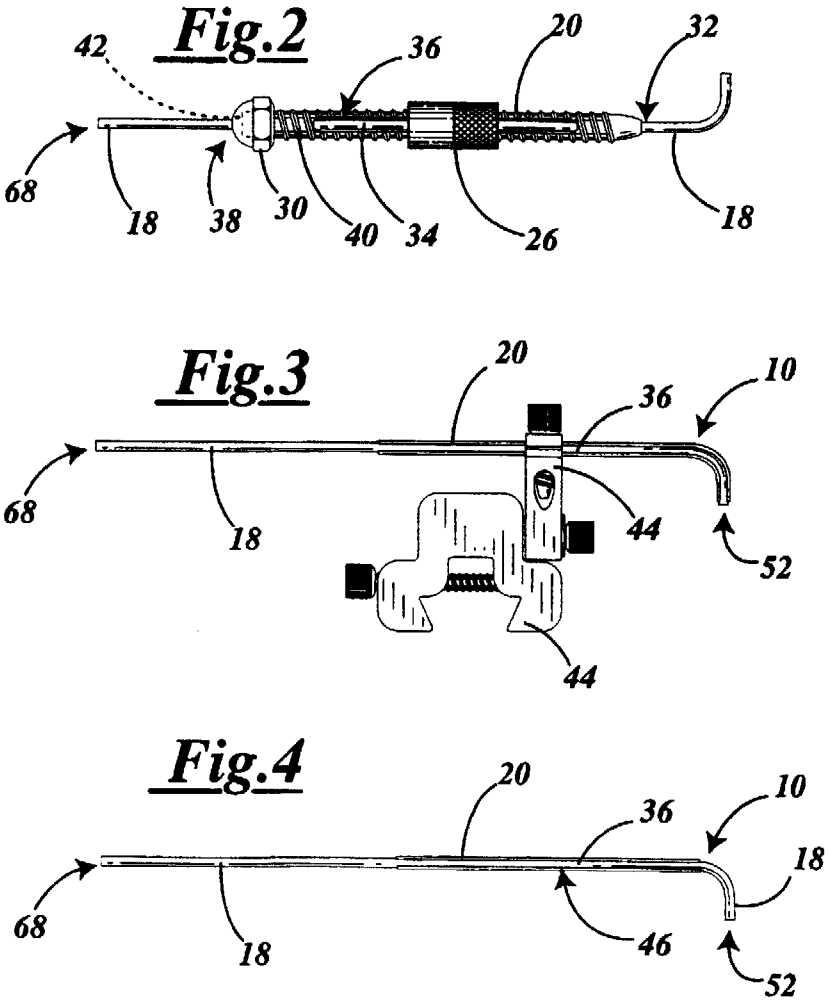
Fig.2
Fig.3
Fig.4
10
18
20
26
32
34
36
38
40
42
44
46
52
68
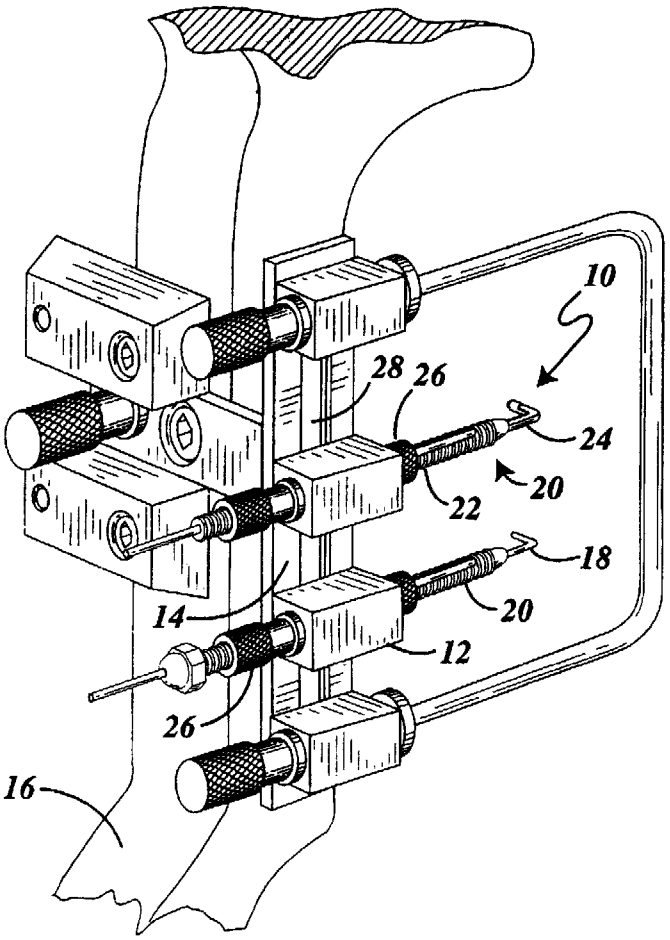
Fig.1
10
12
14
16
18
20
22
24
26
28

AIMING DEVICE FOR USE ON ARCHERY BOWS

BACKGROUND OF THE INVENTION

I. Field of the Invention

This invention relates generally to archery equipment and more particularly to an aiming device for attachment to a sight mount of an archery bow. The aiming device includes a light collecting fiber optic rod protected by a sheath. The sheath includes a window that increases the amount of light collecting surface area of the fiber optic rod exposed to light. The aiming device also includes an inexpensive, fine tuning, adjustment for adjusting the position of the sighting face relative to the sight mount.

II. Discussion of the Related Art

Over the years, continued refinements have been made to the archery bow. Various aiming devices have been attached to the bow to assist the archer in aiming the bow. Specifically, sight pins, scopes, notches, cross hairs, etc. have been mounted onto the bow and used as a reference point for the archer when aiming at a particular object. The sight pins have been mounted to mounting brackets which are in turn mounted to the archer's bow. These sighting pins generally include a threaded body portion tapering to a point or sighting face. Mounting sleeves engage with the thread of the body portion and are used to fasten the sighting pin to the sighting bracket.

There are times, when natural ambient light is not sufficient to assist the archer in seeing the sight pin. Various devices have been devised to illuminate the sight pin and assist the archer in seeing the sight pin. The following patents describe an illuminated aiming device whereby the sight is illuminated with the aid of artificial light: Ritter Von Skoda, U.S. Pat. No. 529,424; Meister et al., U.S. Pat. No. 5,152,068; Spencer, U.S. Pat. No. 3,945,127; Hindes, U.S. Pat. No. 4,177,572; Carollo et al., U.S. Pat. No. 4,166,324; Mann et al., U.S. Pat. No. 4,170,071; Robinson, U.S. Pat. No. 4,195,414; Duerst, U.S. Pat. No. 4,325,190; Mason, U.S. Pat. No. 4,400,887; Kowalski, U.S. Pat. No. 4,495,705; Mueller, U.S. Pat. No. 5,375,047; Ziller, U.S. Pat. No. 5,122,932; and Shafer, U.S. Pat. No. 5,341,791. It has now become illegal in many states to hunt with the aid of artificial light including using sights which utilize artificial light. Other record keeping organizations will not keep records if sights utilizing artificial light have been used. Hence, a need exists for a sight pin which the archer may see in low ambient natural light situations without the need of artificial light. Other patents, including Sherman, U.S. Pat. Nos. 5,201,124, 4,928,394, and 5,231,765 and Saunders, U.S. Pat. No. 5,094,002, disclose the use of a light gathering sight element as a portion of the sight pin. None of these patents describe or show the light gathering sight element protected by a sheath. Typically, when an archer carries the bow through woods and brush, the sight pins are likely to come in contact with a twig or branch. During low temperatures, the light emitting element tends to become brittle and easily breaks off or bends when lightly contacted.

A smaller sighting surface is preferred, to improve the precise aim point. However, the smaller the diameter fiber optic and sighting face, the more fragile the fiber optic becomes and the total light collecting surface area is also reduced. The Sherman '124 patent attempts to address this issue by providing a large diameter fiber optic rod which tapers to a smaller sighting faced diameter. Even larger diameter fiber optic rods can become brittle and break. Therefore, a need exists for an aiming device having a small sighting face surface which may be used in low natural ambient lighting situations, wherein the light collecting surface rod is protected from breakage.

As the archer adjusts the positioning of the sight pin relative to the sighting mount, the sighting face may be moved horizontally either in or out to affect the direction in which the arrow travels. The current adjusting mechanisms require that the sighting face and pin be rotated along threads either in or out. When the end of the sighting pin is in a form of a T or L the pin must be rotated either one-half or a full revolution. This amount of rotation may overcompensate for the amount the pin should be moved. Hence, there is a need for a sighting pin which may be precisely adjusted either closer or away from the sighting bracket.

A micrometer has been known to be adapted to a sighting pin and sighting bracket which allows for precise adjustment. However, these devices are expensive, fragile, and increase the overall weight of the bow. The present invention overcomes these and other disadvantages.

SUMMARY OF THE INVENTION

The purpose of the present invention is to provide an aiming device for attachment to a sight bracket of an archery bow, wherein the aiming device is precisely adjustable and is usable in low light situations without using artificial light. The mounted aiming device consists of a sighting rod, a sheath, an end cap, and mounting sleeves. In the preferred embodiment, the sighting rod and sheath are slidingly mountable in either a standard dovetail mount or mount and slotted sight brackets.

The sighting rod is preferably manufactured from a light gathering polymer fiber optic or polymer rod having a florescent dye pigment extruded therein. Without limitation, the fiber optic rod is preferably 0.030–0.130 inches in diameter. A sheath having a longitudinal central bore attaches to the sight bracket of the archery bow. The diameter of the bore of the sheath is such that the fiber optic slides through the bore wherein a portion of the fiber optic's length is surrounded. The sheath provides rigidity to the fiber optic, thereby allowing a smaller diameter fiber optic to be used. The sheath also minimizes accidental bending and breakage of the fiber optic. An aperture extending into the central longitudinal bore is formed on a longitudinal portion of the sheath. This aperture defines a window which exposes an additional light collecting surface of the fiber optic rod. This allows the length of the fiber optic rod to be reduced, and further, increases the illumination at the end of the fiber optic.

A threaded end cap having a central longitudinal bore is removably attached to an end of the sheath. The end caps bore slidingly receives the fiber optic rod. A formable neoprene gasket having a similar diameter bore is aligned within the end cap, whereby, when the end cap is tightened onto the sheath, the gasket is compressed and applies a force against the fiber optic rod. In this manner, the end cap prevents movement of the fiber optic rod within the sheath. The end cap may be loosened and the fiber optic rod slightly slid through the end cap. In this manner, the length of the fiber optic rod extending from the sheath may be precisely adjusted.

An outer surface of the sheath may have a helical ridge or thread formed thereon. The mounting sleeve is also threaded whereby the sleeve may be rotated onto the sheath. The mounting sleeves may be used to secure the sheath and fiber optic to the sight bracket.

The length of the fiber optic terminates in a sighting face of varying geometric shapes. These geometric shapes enhance the gathering property of the fiber optic. For example, a concave end of the fiber optic exhibits an increased amount in illumination over, for example, a flat surface. Other geometric shapes of varying light gathering enhancement properties include a convex, a spherical, and a pointed end.

The sighting face end of the fiber optic may be terminated in a curved segment that projects perpendicular to the remaining major segment of the fiber optic. In this manner, the fiber optic and sheath may be adjusted such that the sighting face is pointed directly toward the archer. The sheath may be constructed of a two-piece first and second sheath member or one continuous sheath or jacket. When the sheath is constructed of a two-piece member, the first member has a thin side wall of slightly larger diameter than the fiber optic. The second member has a longitudinal bore having a diameter slightly larger than the outer diameter of the first member. The first member is slid into the bore of the second member and may be glued or otherwise fastened in place. In the preferred embodiment, both the first and second members have formed, in the respective sidewall, a window defining aperture. The sheath or second member may have a smooth or threaded external surface. A smooth surfaced sheath slides into a mounting block which is mounted onto the sight bracket.

It is accordingly a principal object of the present invention to provide an aiming device that reduces the size of the sighting face, while remaining visible in low light situations without the use of artificial lighting.

A further object of the present invention is to provide a fiber optic sight pin with enhanced light gathering capabilities.

Another object of the present invention is to provide an aiming device that includes an inexpensive means for precisely adjusting the position of the fiber optic rod relative to the sight bracket.

Yet another object of the present invention is to provide a sheath for protecting a fiber optic sighting rod wherein the sheath has a window to thereby increase the amount of light collecting surface area of the sighting rod without requiring an increase to the overall length of the sighting rod.

These and other objects, as well as these and other features and advantages of the present invention will become readily apparent to those skilled in the art from a review of the following detailed description of the preferred embodiment in conjunction with the accompanying drawings and claims.

DESCRIPTION OF THE DRAWINGS

FIG. 1 is a partial perspective view of a fiber optic sight pin mounted to a sight bracket of an archery bow;

FIG. 2 is a top view of a preferred sight pin;

FIG. 3 is a top view of an alternate preferred sight pin fastened to a dovetail mount;

FIG. 4 is a top view of a fiber optic partially encompassed by a first sheath member;

DETAILED DESCRIPTION OF THE PREFERRED EMBODIMENT

Figure 5:
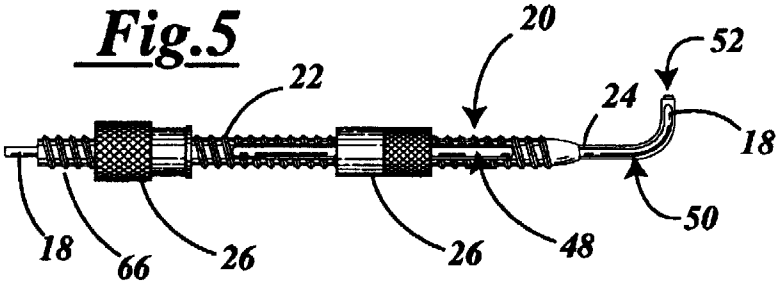
FIG. 5 is a top view of an alternate preferred sight pin having first and second sheath members.

Referring first to FIG. 1, there is shown generally an aiming device or sight pin 10 attached to a mount 12 and sight bracket 14 of an archery bow 16. The sight pin 10 includes a fiber optic rod 18 and a sheath 20. The sheath may comprise first and second sheath members 22 and 24 as further described below. The sight pin 10 is fastened to the mount 12 by one or more sleeves 26. The vertical alignment of the sight pin 10 may be adjusted by sliding the mount 12 either up or down in the slot 28 of the sight bracket 14 to the desired position and then fastening the mount 12 to the sight bracket 14. The horizontal positioning of the sight pin 10 is described below.

Referring next to FIG. 2, a sight pin 10 is shown having an end cap 30 and sleeve 26 attached thereto. A fiber optic rod 18 extends through a longitudinal bore 32 formed in the sheath 20. The sheath 20 provides rigidity to the fiber optic rod 18 and minimizes the amount of unprotected fiber optic rod. Without limitation, the sheath 20 is manufactured from a metal or metal alloy. Of course a rigid polymer may also be used. An aperture 34 extends from an outer surface of sheath into the longitudinal bore 32. The aperture 34 defines a window 36 that permits ambient light to be absorbed by the fiber optic rod's 18 light collecting surface. By increasing the amount of fiber optic's light collecting surface area exposed to light through the window 36, the necessary length of the fiber optic rod 18 for adequate illumination is reduced.

The threaded end cap 30 having a central longitudinal bore 38 is removably attached to an end 40 of the sheath 20. Those skilled in the art will recognize that the end cap 30 may be of a self threading type of known construction. The end cap's 30 bore 38 slidingly receives the fiber optic rod 18. A stretchable or formable neoprene gasket 42 having a bore with an inner diameter slightly less than the outer diameter of the fiber optic rod 18 is aligned within the end cap 30. When the end cap 30 is tightened onto the sheath 20, the gasket 42 is compressed thereby applying a force against the fiber optic rod 18. In this manner, the end cap 30 prevents movement of the fiber optic rod 18 within the sheath 20. The end cap 30 may be loosened and the fiber optic rod 18 slightly slid through the end cap 30. In this manner, the length of the fiber optic rod 18 extending from the sheath 20 may be precisely adjusted. The outer surface of the sheath 20 may be calibrated such that the user may readily identify the precise position of the fiber optic rod 18 relative to the sheath 20.

Referring next to FIG. 3, an alternate preferred sight pin 10 is shown mounted within a dovetail mount 44. The fiber optic rod 18 may be longitudinally encapsuled by a sheath member 20, wherein the sheath member 20 has a smooth external surface. The sheath member 20 is clamped in position within a bore of the dovetail mount 44. The sheath member 20 has a slot 46 that extends its length, and defines a window 36 to thereby increase the amount of exposed light collecting surface area of the fiber optic rod 18. The sheath 20 may extend to the sighting face 52 or may terminate prior to the bend in the fiber optic rod 18 (compare FIGS. 3 and 4).

Figure 6:
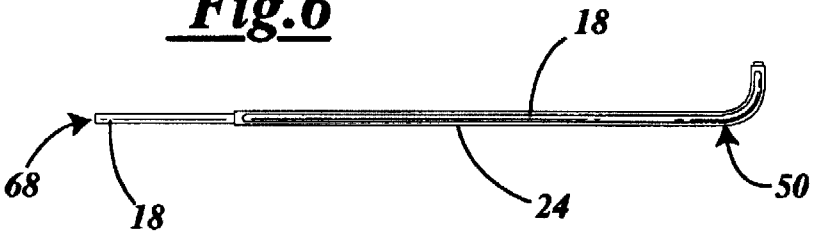
FIG. 6 is a top view of a fiber optic and second sheath member of the type shown in FIG. 5.

Referring now to FIG. 5, an alternate preferred sight pin 10 is shown having two mounting sleeves 26 attached. The sight pin 10 has a fiber optic rod 18 and a sheath 20 comprising a first and second sheath member 22 and 24. The first sheath member 22 has a longitudinal bore extending through its length. An aperture extends through a portion of the first sheath from its outer surface into the bore, thereby defining a first window 48. The outer diameter of the second sheath member 24 is sized slightly smaller than the inner diameter of the first sheath's 22 bore. The second sheath member 24 slidingly engages through the bore of the first sheath member 22. The second sheath member 24 has a longitudinal bore extending therethrough, and an aperture extending from the second sheath member's outer surface into its bore to thereby define a second window 50. The fiber optic rod 18 is sized to press fit into the bore of the second sheath member 24 (see FIG. 6). Of course, those skilled in the art will recognize that a looser fitting fiber optic rod 18 may be held in place with an adhesive or the end cap 30 as described above. When the second sheath member 24 is slid into the first sheath member 22, the first and second windows 48 and 50 are aligned, thereby increasing the amount of fiber optic rod 18 exposed to light.

Figure 7:
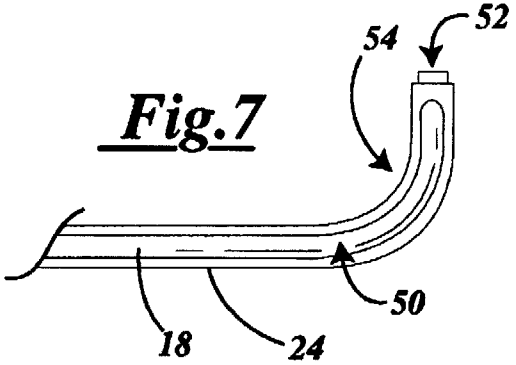
FIG. 7 is a partial enlarged view of the sight pin of the type shown in FIG. 5.
Figure 8:
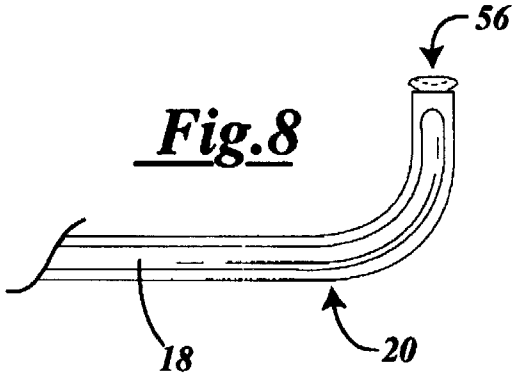
FIG. 8 is a partial top view of a fiber optic rod having a concave sighting face.
Figure 9:
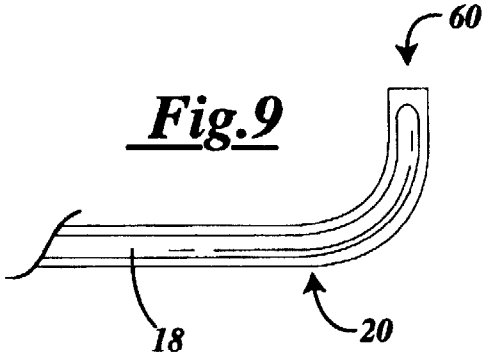
FIG. 9 is a partial top view of a fiber optic rod having a flat sighting face.
Figure 10:
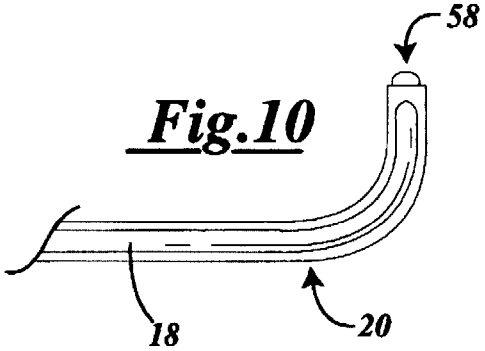
FIG. 10 is a partial top view of a fiber optic rod having a convex sighting face.

Referring now to FIG. 7, the end of the fiber optic rod 18 which terminates in a sighting face 52 forms a curved segment 54. The curved segment 54 projects perpendicular to a remaining major segment of the fiber optic rod 18. The second sheath member 24 extends around the curved segment 54. The sighting pin 10 is generally aligned and attached to the sight bracket 14, whereby the small precise sighting face 52 points in the direction of the archer. The second sheath member 24 provides rigidity to the fiber optic rod 18 and reduces the possibility that a branch could snap off or bend the sighting end of the fiber optic rod 18.

Figure 11:
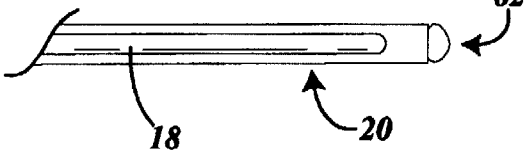
FIG. 11 is a partial top view of a fiber optic rod having a spherical sighting face.
Figure 12:
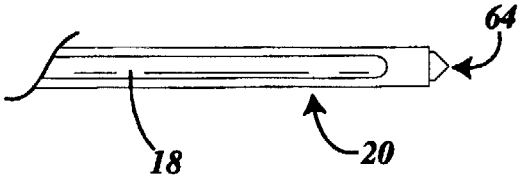
FIG. 12 is a partial top view of a fiber optic rod having a pointed sighting face.

The sighting face 52 of the fiber optic rod 18 may be shaped in one of several light gathering and enhancing shapes including, but not limited to a concave end 56, a convex end 58, a flat end 60, a spherical end 62, or a pointed end 64. FIGS. 8–12 depicts each of these shapes. A concave sighting surface 56 (see FIG. 8) or convex sighting surface 58 (see FIG. 10) increases the amount of illuminated surface (as compared to a flat sighting surface 60 shown in FIG. 9) without increasing the diameter of the fiber optic rod's 18 sighting end 52. The fiber optic rod 18 may be constructed without a curved segment 54 when the sighting face 52 is spherical 62 or pointed 64, as shown in FIGS. 11 and 12 respectively. When a fiber optic rod 18 is used having a spherical or pointed sighting surface, the sheath 20 encompasses the length of the fiber optic rod 18 up to the spherical or pointed sighting face.

Having described the apparatus of the present invention, its use will now be discussed. The sight pin 10 is mounted to an archer's sight bracket 14. The fiber optic rod 18 is protected from breakage by the sheath 20. The sheath may have either a smooth outer surface or a threaded 66 (helical ridges formed thereon) outer surface, depending upon the type of mount and sight bracket the archer prefers to use. The sheath 20 may also comprise a first and second sheath member 22 and 24, each of which have a window 48 and 50 defining aperture. The aligned windows 48 and 50 expose more fiber optic 18 to light. The non-sighting end 68 of the fiber optic 18 protrudes from the sheath 20 and may be at least partially protected by the archer's quiver (not shown) mounted to the bow 16. The archer may adjust both the vertical and horizontal alignment of the sighting pin 10. An end cap 30 may be used to efficiently and precisely adjust the horizontal alignment of the sighting pin 10. To adjust the horizontal alignment of the pin, the end cap 30 is loosened and the fiber optic 18 is slid a predetermined distance through the end cap 30. The end cap 30 is then tightened, to thereby inhibit movement of the fiber optic 18. The end cap 30 may be used on each of the preferred embodiments described above, wherein the sheath 20 has a threaded 66 external surface.

Ambient light is collected through the exposed fiber optic rod's surface, and is directed to the ends of the fiber optic rod 18. The sighting face 52 of the fiber optic rod 18 has a glowing appearance. When using these sight pins 10, the archer is able to identify and aim with the sight pin 10 even in low ambient light situations. The sight pin 10 is kept rigid by the sheath 20 which also protects the end of the sight pin 10 from breakage.

This invention has been described herein in considerable detail in order to comply with the patent statutes and to provide those skilled in the art with the information needed to apply the novel principles and to construct and use such specialized components as are required. However, it is to be understood that the invention can be carried out by specifically different devices, and that various modifications, both as to the equipment details and operating procedures, can be accomplished without departing from the scope of the invention itself.

What is claimed is:

1. An aiming device for attachment to a sight bracket of an archery bow comprising:

(a) a fiber optic rod wherein an end of said fiber optic rod both terminates in a sighting face and forms a curved segment projecting perpendicular to a remaining major segment of said fiber optic rod; and (b) a curved sheath for attachment to the sight bracket of the archery bow, said sheath surrounding at least a portion of both the major segment and curved segment of said fiber optic rod, wherein said sheath provides rigidity to said fiber optic rod, said sheath having a window defining aperture exposing at least a portion of both the major segment and curved segment of said fiber optic rod, thereby increasing an exposed light collecting surface of said fiber optic rod.

2. An aiming device as recited in claim 1, wherein said sheath comprises a first and second sheath member, each said first and second sheath member having a window defining aperture to thereby increase the exposed light collecting surface of said fiber optic rod.

3. An aiming device as recited in claim 1, further comprising an end cap removably attached to an end of said sheath, distal to said sighting face, said end cap having a bore for slidingly receiving said fiber optic rod wherein said end cap includes a gasket retained therein, said gasket engaging an outer surface of said fiber optic rod, to thereby hold said fiber optic rod in a fixed position when the cap is firmly attached to the end of said sheath.

4. An aiming device as recited in claim 1, wherein an external longitudinal surface of said sheath includes a helical ridge formed thereon.

5. An aiming device as recited in claim 4, wherein said helical ridge is adapted to receive at least one sleeve for fastening said sheath to the sight bracket of the archery bow.

6. An aiming device as recited in claim 1, wherein said sighting face is constructed in a light gathering and enhancing shape selected from the group consisting of a concave, a convex, a flat, a spherical, and a pointed end.

7. An aiming device for attachment to a sight bracket of an archery bow comprising:

(a) a fiber optic rod wherein an end of said fiber optic rod both terminates in a sighting face and forms a curved segment projecting perpendicular to a remaining major segment of said fiber optic rod, said sighting face is constructed in a light gathering and enhancing shape selected from the group consisting of a concave, a convex, a flat, a spherical, and a pointed end; and (b) a curved sheath for attachment to the sight bracket of the archery bow, said sheath surrounding at least a portion of both the major segment and curved segment of said fiber optic rod, wherein said sheath provides rigidity to said fiber optic rod, said sheath having a window defining aperture exposing at least a portion of both the major segment and curved segment of said fiber optic rod, thereby increasing an exposed light collecting surface of said fiber optic rod.

8. An aiming device as recited in claim 7, further comprising an end cap attached to an end of said sheath, distal to said sighting face, said end cap having a bore for slidingly receiving said fiber optic rod wherein said end cap includes a gasket retained therein, said gasket engaging an outer surface of said fiber optic rod, to hold said fiber optic rod in a fixed position when the cap is firmly attached to the end of said sheath.

9. An aiming device as recited in claim 7, wherein an external longitudinal surface of said sheath includes a helical ridge formed thereon.

10. An aiming device as recited in claim 9, wherein said helical ridge is adapted to receive at least one sleeve for fastening said sheath to the sight bracket of the archery bow.

11. A device for aiming an archery bow comprising:

(a) a fiber optic rod wherein an end of said fiber optic rod terminates in a sighting face;

(b) first and second sheaths for attachment to a sight bracket of an archery bow, said second sheath surrounding a longitudinal portion of said fiber optic rod, wherein said second sheath provides rigidity to said fiber optic rod, said first and second sheath having a window defining aperture exposing said fiber optic rod, thereby increasing a light collecting surface of said fiber optic rod, said second sheath slidingly engaged within a lumen of said first sheath; and (c) an end cap attached to an end of said first sheath, distal to said sighting face, said end cap having a bore for slidingly receiving said fiber optic rod wherein said end cap includes a gasket retained therein, said gasket engages an outer surface of said fiber optic rod.

12. A device as recited in claim 11, wherein an external longitudinal surface of said first sheath includes a helical ridge formed thereon.

13. A device as recited in claim 12, wherein said helical ridge is adapted to receive at least one sleeve for fastening said first sheath to the sight bracket of the archery bow.

14. A device as recited in claim 11, wherein said sighting face is constructed in a light gathering and enhancing shape selected from the group consisting of a concave, a convex, flat, spherical, and pointed end.

15. An aiming device for attachment to a sight bracket of an archery bow comprising:

(a) a sighting rod wherein an end of said sighting rod both terminates in a sighting face and forms a curved segment projecting perpendicular to a remaining major segment of said sighting rod;

(b) first and second sheaths for attachment to the sight bracket of the archery bow, said second sheath surrounding at least a portion of both the major segment and curved segment of said sighting rod to thereby provide rigidity to said sighting rod, said first and second sheath having a window defining aperture exposing said sighting rod, thereby increasing a light collecting surface of said sighting rod, wherein said second sheath slidingly engages within a lumen of said first sheath and an external longitudinal surface of said first sheath includes a helical ridge formed thereon; and (c) an end cap adapted to engage said helical ridge formed on said first sheath, said end cap having a bore for slidingly receiving said sighting rod wherein said end cap includes a gasket retained therein, said gasket engages an outer surface of said sighting rod.

16. An aiming device as recited in claim 15, wherein said helical ridge is adapted to receive at least one sleeve for fastening said first sheath to the sight bracket of the archery bow.

* * * * *